US008031155B2

(12) United States Patent
Jeoung et al.

(10) Patent No.: US 8,031,155 B2
(45) Date of Patent: Oct. 4, 2011

(54) LIQUID CRYSTAL DISPLAY DEVICE

(75) Inventors: Hun Jeoung, Gyeongsangbuk-do (KR); Young Hak Lee, Gyeongsangbuk-do (KR)

(73) Assignee: LG Display Co., Ltd., Seoul (KR)

( * ) Notice: Subject to any disclaimer, the term of this patent is extended or adjusted under 35 U.S.C. 154(b) by 784 days.

(21) Appl. No.: 11/313,747

(22) Filed: Dec. 22, 2005

(65) Prior Publication Data

US 2006/0274570 A1 Dec. 7, 2006

(30) Foreign Application Priority Data

Jun. 3, 2005 (KR) ..... 10-2005-0047650

(51) Int. Cl.
*G09G 3/36* (2006.01)

(52) U.S. Cl. ..... 345/98; 345/55; 345/87; 345/100

(58) Field of Classification Search ..... 345/55, 345/60, 63, 76–78, 80, 84, 87–111
See application file for complete search history.

(56) References Cited

U.S. PATENT DOCUMENTS 6,337,722 B1 1/2002 Ha
6,525,556 B2 * 2/2003 Matsueda ..... 324/770
6,624,857 B1 * 9/2003 Nagata et al. ..... 349/54
2003/0151587 A1 8/2003 Yamashita
2003/0179164 A1 * 9/2003 Shin et al. ..... 345/76

FOREIGN PATENT DOCUMENTS

EP 0 895 220 2/1999
JP 2002-098999 4/2002

* cited by examiner

*Primary Examiner* — Alexander Eisen
*Assistant Examiner* — Christopher E Leiby
(74) *Attorney, Agent, or Firm* — Morgan, Lewis & Bockius LLP

(57) ABSTRACT

A liquid crystal display device includes a display unit having matrix type pixels defined by gate and data lines crossing with each other, a data driver to supply a data voltage to be supplied to the data lines via output lines, the output lines being less in number than the data lines, a plurality of demultiplexers, each including a plurality of switching devices having a gate terminal, source terminal and a drain terminal, wherein the gate terminals are supplied with a plurality of control signals, the source terminals are commonly connected to the corresponding output line, and the drain terminals are individually connected to one side of the data lines, respectively, a data line check unit activated to supply a test data voltage to the other side of the data lines when the data driver is inactive, a plurality of signal input lines individually connected to the gate terminals, respectively, an input terminal supplied with a cutoff signal to be inputted to the signal input lines to turn off the switching devices, and a switching unit electrically connecting/disconnecting the input terminal to/from the signal input lines according to an external control signal.

8 Claims, 6 Drawing Sheets

LIQUID CRYSTAL DISPLAY DEVICE

This application claims the benefit of the Korean Patent Application No. P2005-0047650 filed on Jun. 3, 2005, which is hereby incorporated by reference.

BACKGROUND OF THE INVENTION

1. Field of the Invention

The present invention relates to a liquid crystal display device, and more particularly, to a liquid crystal display device and driving method thereof.

2. Discussion of the Related Art

Generally, a liquid crystal display (LCD) device displays a picture corresponding to a video signal (i.e., "data voltage") using a display unit having a plurality of pixels defined by gate and data lines crossing with each other. Each pixel of the display unit consists of a liquid crystal cell adjusting light transmittance according to a corresponding data voltage. A thin film transistor (TFT) acts as a switching device to supply a data voltage from a data line to the liquid crystal cell. The LCD device also includes a gate driver for driving the gate lines and a data driver for driving the data lines. In a liquid crystal panel where the TFT is formed of polysilicon having high electric charge mobility, the gate and data drivers are built in the liquid crystal panel. In such a case, a demultiplexer unit is provided between the data driver unit and the display unit. The demultiplexer unit connects a plurality of data lines to one output line of the data driver, thereby reducing a required number of drive ICs (integrated circuit) needed to configure the data driver.

An LCD device provided with a demultiplexer unit according to a related art is explained with reference to the attached drawings as follows. FIG. 1 shows a block diagram of an LCD device according to a related art.

As shown in FIG. 1, an LCD device according to the related art includes of a display unit 111 on which m-gate lines GL1 to GLm and n-data lines DL1 to DLn perpendicularly cross each other to form (m×n) pixels arranged in a matrix form. A TFT is provided at each intersection of the gate and data lines. A gate driver 101 provides a scan pulse voltage SP to the gate lines GL1 to GLm and a data driver 102 supplies data voltages VD1 to VDk to the data lines DL1 to DLn of the display unit 111. A demultiplexer unit 105 is connected between the display unit 111 and the data driver 102, and a timing controller 106 controls the gate driver 101, the data driver 102, and the demultiplexer unit 105.

The timing controller 106 generates a plurality of control signals to control the drive timing of the gate and data drivers 101 and 102 and aligns pixel data to be applied to the data driver 102. Further, the timing controller 106 generates a plurality of control signals to control the demultiplexer unit 105.

The data driver 102 has a number of output lines OL1 to OLk connected to the output pins (not shown) of the data driver 102. The number of output pins (k) is equal to the number of output lines OL1 to OLk. However, the number of output lines OL1 to OLk connected between the data driver 102 and the demultiplexer unit 105 is smaller than a number of the data lines DL1 to DLn. The demultiplexer unit 105 is explained in detail as follows.

FIG. 2 shows a detailed schematic diagram of the demultiplexer unit 105 shown in FIG. 1. FIG. 3 shows a diagram of drive waveforms of a first demultiplexer DEMUX1 shown in FIG. 2 during a random horizontal sync interval.

As shown in FIG. 2, the demultiplexer unit 105 includes k-demultiplexers DMUX1 to DEMUXk connected between the data driver unit 102 and n-data lines DL1 to DLn of the display unit 111. Each of the demultiplexers DEMUX1 to DEMUXk includes first to third switching devices SW1 to SW3 connected in parallel to one output line OLk and to three of the data lines DL1 to DLn, respectively. The first to third switching devices SW1 to SW3 are turned on at different times in one horizontal period by first to third control signals C1 to C3 supplied from the timing controller 106, respectively. The gate driver 101 sequentially supplies a scan pulse voltage SP to m-gate lines GL1 to GLm during one frame. As shown in FIG. 3, a gate high voltage VGH, which is a high logic voltage of the scan pulse voltage SP, is maintained to drive a corresponding gate line during one horizontal sync period. In this case, the gate high voltage VGH is set to a voltage level that is greater than a threshold voltage of the TFT. Conversely, a gate low voltage VGL is a low logic voltage of the scan pulse voltage SP set as an off-voltage of the TFT.

During a horizontal sync period Hi of driving a selected gate line, the data driver 102 sequentially supplies k-data voltages VD1 to VDk to k-output lines OL1 to OLk connected to the k-demultiplexers DEMUX1 to DEMUXk, respectively. The k-data voltages VD1 to VDk supplied to the k-demultiplexers DEMUX1 to DEMUXk are synchronized with the first to third control signals C1 to C3 from the timing controller 106 to supply three data voltages from each of the k-data voltages VD1 to VDk to the three data lines connected to each of the demultiplexers DEMUX1 to DEMUXk to supply data signals to the n-data lines DL1 to DLn.

More specifically, in each of the k-demultiplexers DEMUX1 to DEMUXk, a gate electrode of the first switching device SW1 is connected to a signal input line IL of the first control signal C1. Likewise, a gate electrode of the second switching device SW2 is connected to a signal input line IL of the second control signal C2, and a gate electrode of the third switching device SW3 is connected to a signal input line IL of the third control signal C3. Hence, when the first to third control signals C1 to C3, as shown in FIG. 3, are sequentially shifted to a high state in one horizontal sync period Hi, the first to third switching devices SW1 to SW3 of each of the demultiplexers DEMUX1 to DEMUXk are driven in sequence from of the first switching device SW1 to the third switching device SW3. The data driver 102 sequentially outputs the corresponding data voltages VD1 to VDk to correspond to the drive sequence of the first to third switching devices SW1 to SW3. As a result, the first demultiplexer DEMUX1, as shown in FIG. 3, sequentially supplies the data voltage for R (red) to the first data line DL1 via the first switching device SW1, the data voltage for G (green) to the second data line DL2 via the second switching device SW2, and the data voltage for B (blue) to the third data line DL3 via the third switching device SW3.

In the LCD device of the related art, the display unit 111, the gate driver 101, data driver 102, and each of the demultiplexers DEMUX1 to DEMUXk to drive the display unit 111 are built into an LCD panel 100. In particular, the data driver 102 of a chip-type is mounted on the LCD panel 100 (e.g., chip on glass "COG"). The timing controller 106 is provided external to the LCD panel 100.

To check whether the image according to the data voltages VD1 to VDk is correctly displayed on each of the pixels, the related art liquid crystal display device further includes a gate line check unit of checking a presence or absence of errors on the gate lines GL1 to GLm and a data line check unit of checking a presence absence of error on the data lines DL1 to DLn. A liquid crystal display device having a gate line check unit and a data line check unit according to the related art is explained in detail as follows.

FIG. 4 shows a block diagram of an LCD device having a gate line check unit and a data line check unit according to the related art. As shown in FIG. 4, an LCD device according to the related art includes of a display unit 111 on which m-gate lines GL1 to GLm and n-data lines DL1 to DLn perpendicularly cross each other to form (m×n) pixels arranged in a matrix form. A TFT is provided at each intersection of the gate and data lines. A gate driver 101 provides a scan pulse voltage SP to the gate lines GL1 to GLm and a data driver (not shown) supplies data voltages VD1 to VDk to the data lines DL1 to DLn of the display unit 111. A plurality of demultiplexers DEMUX1 to DEMUXk is connected between the display unit 111 and the data driver (not shown). A timing controller (not shown) controls the gate driver 101, the data driver (not shown), and the demultiplexers DEMUX1 and DEMUXk. A gate line check unit 403 checks for a presence or absence of errors on the gate lines GL1 to GLm by supplying a test scan pulse voltage VT to the gate lines GL1 to GLm of the display unit 111. A data line check unit 404 checks for a presence or absence of errors on the data lines DL1 to DLn by supplying test data voltages VTR (red), VTG (green), and VTB (blue) to the data lines DL1 to DLn of the display unit 111. In particular, each of the demultiplexers DEMUX1 to DEMUXk has the same configuration of the demultiplexer shown in FIG. 2.

The gate line check unit 403 is connected to one end of each of the gate lines GL1 to GLm and the gate driver 101 is connected to the other end of each of the gate lines GL1 to GLm. Similary, the data line check unit 404 is connected to one end of each of the data lines DL1 to DLn and the data driver 102 is connected to the other end of each of the data lines DL1 to DLn via the demultiplexers DEMUX1 to DEMUXk, respectively.

The gate line check unit 403 includes m-fourth switching devices SW4 supplying the test scan pulse voltage VT to the m-gate lines GL1 to GLm in response to a fourth control signal C4. Namely, one of the fourth switching devices SW4 is connected to one gate line. In particular, gate terminals of the fourth switching devices SW4 are connected in parallel to be supplied with the fourth control signal C4 in common. Drain terminals are individually connected to the gate lines GL1 to GLm, respectively, and source terminals are connected in parallel to be supplied with the test scan pulse voltage VT in common.

The data line check unit 404 includes n-fifth switching devices SW5 supplying the test data voltages VTR, VTG, and VTB to the data lines DL1 to DLn in response to a fifth control signal C5. In particular, gate terminals of the fifth switching devices SW5 are connected parallel to each other to be supplied with the fifth control signal C5 in common. Drain terminals are individually connected to the data lines DL1 to DLn, respectively, and source terminals are supplied with one of the test data voltages VTR, VTG, and VTB.

As previously described, the gate and data line check units 403 and 404 are provided to check whether the gate and data lines GL1 to GLm and DL1 to DLn are in proper operating conditions. When the gate and data line check units 403 and 404 are activated, the gate and data drivers 101 and 102 are deactivated. Specifically, the gate and data line check units 403 and 404 are to temporarily operate the gate and data lines GL1 to GLm and DL1 to DLn before the LCD device is activated by the gate and data drivers 101 and 102 for normal operation. Hence, while the gate and data line check units 403 and 404 are in operation, the gate and data drivers 101 and 102 are disabled. Conversely, during normal operations, the gate and data line check units 403 and 404 are disabled while the gate and data drivers 101 and 102 and the timing controller (not shown) are activated.

The display unit 111, the gate driver 101, the data driver (not shown), the gate line check unit 403, the data line check unit 404, and the demultiplexers DEMUX1 to DEMUXk are built into the LCD panel (not shown). Similar to the description above in relation to FIGS. 1 and 3, the data driver is mounted on the LCD panel in the form of a chip. The timing controller is provided external the LCD panel.

In the related art, the process of checking the gate and data lines GL1 to GLm and DL1 to DLn is carried out prior to loading the data driver 102 and the timing controller 106. Hence, the gate and data drivers 101 and 102 are disabled in the checking process. First, by applying the fourth control signal C4 to the gate line check unit 403, the fourth switching devices SW4 of the gate line check unit 403 are turned on. Once the fourth switching devices SW4 are turned on, each of the fourth switching devices SW4 outputs the test scan pulse voltages VT to the gate lines GL1 to GLm, respectively. Hence, all of the TFTs connected to the gate lines GL1 to GLm become active.

Subsequently, by applying the fifth control signal C5 to the data line check unit 404, the fifth switching devices SW5 of the data line check unit 404 are turned on. Once the fifth switching devices SW5 are turned on, each of the fifth switching devices SW5 outputs one of the test data voltages VTR, VTG, and VTB to the data lines DL1 to DLn. In particular, test R data voltages VTR are supplied to every third data line starting with the first data line DL1, i.e., the first data line DL1, the fourth data line DL4, to the (n−2)th data line DLn−2. Similarly, the test G data voltages VTG are supplied to every third data line starting with the second data line DL2, i.e., the second data line DL2, the fifth data line DL5, to the (n−1)th data line DLn−1. Likewise, the test B data voltages VTB are supplied to every third data line starting with the third data line DL3, i.e., the third data line DL3, the sixth data line DL6, to the nth data line DLn. The test data voltages VTG, VTG, and VTB supplied to the data lines DL1 to DLn are supplied to liquid crystal cells of the pixels via the TFTs turned on by the gate line check unit 403.

In this way, all of the pixels can be tested to display different images according to the test data voltages VTR, VTG, and VTB. In doing so, the success/failure of the gate and data lines GL1 to GLm and DL1 to DLn, i.e., proper connection/disconnection, can be confirmed by checking the abnormality of the picture displayed on the display unit 111. For instance, absence of images horizontally along a certain gate line indicates that the pixels connected to that gate line are not operating. Likewise, absence of images vertically along a certain data line indicates that the pixels connected to that data line are not operating. Moreover, if a specific pixel fails to display an image, such a condition indicates that the TFT connected to that particular pixel is malfunctioning.

In performing the above-explained test process, the first to third switching devices SW1 to SW3 connected to each of the demultiplexers DEMUX1 to DEMUXk need to be prevented from becoming active. If the first to third switching devices SW1 to SW3 are turned on, the active switches SW1 to SW3 create a circuit path between the data lines connected thereto, thereby short-circuiting the data lines DL1 to DLn. In such a case, the test R, G, B data voltages VTR, VTG, and VTB supplied to the data lines DL1 to DLn via the data line check unit 404 become mixed, thereby preventing proper testing of the pixels.

To prevent the first to third switching devices SW1 to SW3 in each of the demultiplexers DEMUX1 to DEMUXk from becoming active during the testing process, a cutoff signal VOFF is supplied to each of the signal input lines IL connected to the gate terminals of the first to third switching devices SW1 to SW3 to maintain their off-states. The cutoff signal VOFF is supplied from an external source by an operator via input terminals 411. The input terminal 411 is connected to one end of each of the signal input lines IL. Because one input terminal is connected to one input line IL, many input terminals 411 are needed to satisfy a large-scale display device with higher resolution.

As the display device becomes larger in scale to achieve higher resolution, the number of the data lines DL1 to DLn increases accordingly. In other words, as the number of the data lines DL1 to DLn increases, the number of the switching devices in the demultiplexers DEMUX1 to DEMUXk increases. As the number of the switching devices increases, the corresponding number of the input terminals 411 increases as well. Since the input terminals 411 are formed on the LCD panel 100, an area for accommodating the input terminals 411 increases in size to accommodate the increased number of input terminals 411. Hence, the increasing number of the input terminals 411 contravenes the effort to reduce the size of the LCD panel. Moreover, because the fourth control signal C4, the test scan pulse voltage VT, the fifth control signal C5, and the test data voltages VTR, VTG, and VTB are all provided from an external source, additional input terminals (not shown in the drawing) needed for inputting these signals and voltages also contribute to the size reduction problem.

SUMMARY OF THE INVENTION

Accordingly, the present invention is directed to a liquid crystal display device and driving method thereof that substantially obviate one or more problems due to limitations and disadvantages of the related art.

An object of the present invention is to provide an LCD device with reduced the number of input terminals.

Another object of the present invention is to provide an LCD device with reduced panel size.

To achieve these and other advantages and in accordance with the purpose of the present invention, as embodied and broadly described, a liquid crystal display device includes a display unit having matrix type pixels defined by gate and data lines crossing with each other, a data driver to supply a data voltage to be supplied to the data lines via output lines, the output lines being less in number than the data lines, a plurality of demultiplexers, each including a plurality of switching devices having a gate terminal, source terminal and a drain terminal, wherein the gate terminals are supplied with a plurality of control signals, the source terminals are commonly connected to the corresponding output line, and the drain terminals are individually connected to one side of the data lines, respectively, a data line check unit activated to supply a test data voltage to the other side of the data lines when the data driver is inactive, a plurality of signal input lines individually connected to the gate terminals, respectively, an input terminal supplied with a cutoff signal to be inputted to the signal input lines to turn off the switching devices, and a switching unit electrically connecting/disconnecting the input terminal to/from the signal input lines according to an external control signal.

In another aspect, a liquid crystal display device includes a display unit having matrix type pixels defined by gate and data lines crossing each other, a data driver to supply data voltages to output lines during normal operations, a plurality of demultiplexers to receive the data voltages from data driver via the output lines and to supply the data voltages to the data lines, each of the demultiplexers including a plurality of switching devices having a gate terminal, a source terminal, and a drain terminal, wherein the source terminals of each demultiplexer are commonly connected to the output line corresponding to the demultiplexer, and the drain terminals are individually connected to corresponding ones of the data lines, a plurality of signal input lines individually connected to the gate terminals of the switching devices, an input terminal supplied with a cutoff signal to turn off the switching devices, and a switching unit to electrically connect the input terminal to the signal input lines during testing operations and to electrically disconnect the input terminal from the signal input lines during the normal operations.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENTS

Reference will now be made in detail to the preferred embodiments of the present invention, examples of which are illustrated in the accompanying drawings. Wherever possible, the same reference numbers will be used throughout the drawings to refer to the same or like parts.

Figure 5:
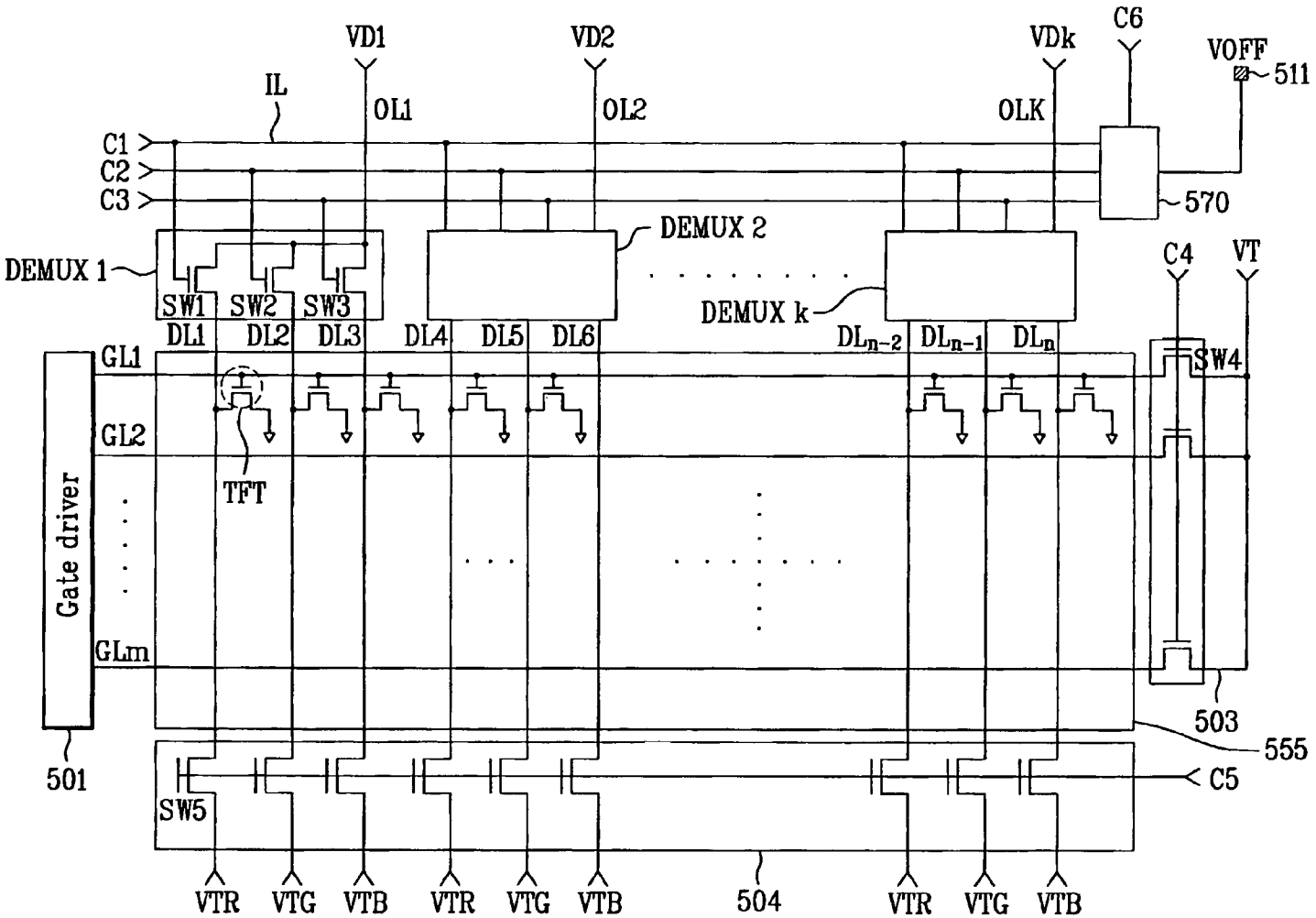
FIG. 5 is a diagram of an LCD device according to an exemplary embodiment of the present invention.
Figure 6:
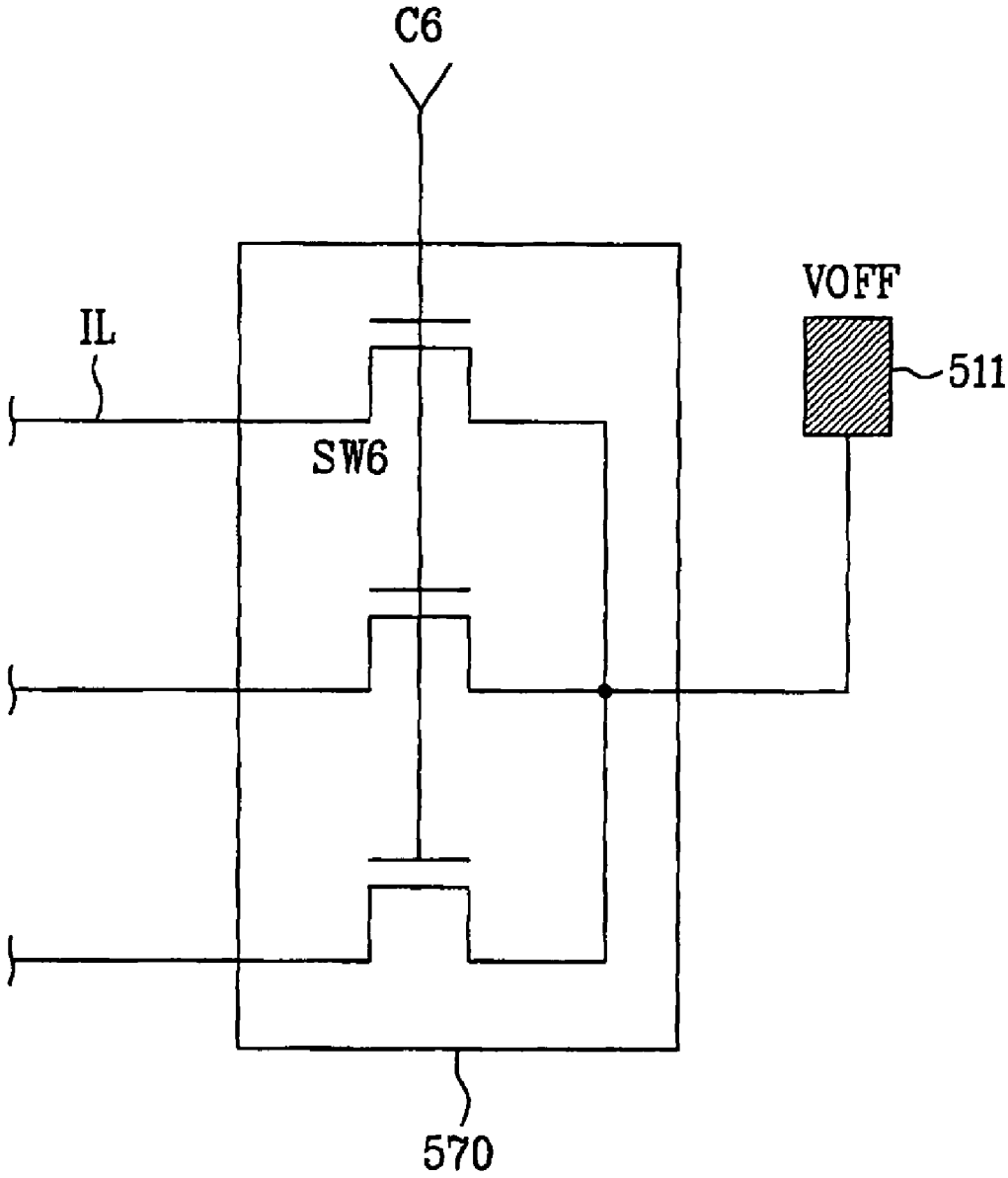
FIG. 6 is a detailed circuit diagram of an exemplary switching unit of FIG. 5.

FIG. 5 shows a diagram of an LCD device according to an exemplary embodiment of the present invention. FIG. 6 is a detailed circuit diagram of an exemplary switching unit of FIG. 5. As shown in FIG. 5, an LCD device according to an exemplary embodiment of the present invention includes a display unit 555 on which (m×n) pixels are arranged in matrix form by m-gate lines GL1 to GLm and n-data lines DL1 to DLn perpendicularly crossing each other and a TFT provided at each intersection of the gate and data lines. A gate driver 501 supplies a scan pulse voltage SP to the gate lines GL1 to GLm and a data driver (not shown) supplies data voltages VD1 to VDk via output lines OL1 to OLk to a plurality of demultiplexers DEMUX1 to DEMUXk. Each of the plurality of demultiplexers DEMUX1 to DEMUXk includes first to third switching devices SW1 to SW3 to sequentially supply the received data voltages VD1 to VDk from the output lines OL1 to OLk to the data lines DL1 to DLn, respectively, where the number of output lines OL1 to OLk is smaller than the number of the data lines DL1 to DLn. A timing controller (not shown) controls the gate driver 501, the data driver (not shown), and the demultiplexers DEMUX1 and DEMUXk.

The LCD device according to the exemplary embodiment of the present invention also includes a gate line check unit 503 to supply a test scan pulse voltage VT to the gate lines GL1 to GLm and a data line check unit 504 to supply test data voltages VTR, VTG, and VTB to the data lines DL1 to DLn. A plurality of signal input lines IL supplying a cutoff signal VOFF to turn off the first to third switching devices SW1 to SW3 in each of the demultiplexers DEMUX1 to DEMUXk is connected to one input terminal 511 that receives the cutoff signal VOFF to be supplied to the signal input lines IL via a switching unit 570. The switching unit 570 electrically connects/disconnects the input terminal 511 to/from the signal input lines IL according to an external sixth control signal C6.

The gate line check unit 503 is connected to one end of the gate lines GL1 to GLm, and the gate driver 501 is connected to the other end of the gate lines GL1 to GLm. During a test process, the gate line check unit 503 applies a test scan pulse voltage VT to the gate lines GL1 to GLm to drive the gate lines GL1 to GLm. During normal operations, the gate driver 501 sequentially supplies the scan pulse voltage SP to the gate lines GL1 to GLm to sequentially drive the gate lines GL1 to GLm.

The data line check unit 504 is connected to one end of the data lines DL1 to DLn, and the data driver (not shown) is connected to the other end of the data lines DL1 to DLn via the demultiplexers DEMUX1 to DEMUXk, respectively. During a test process, the data line check unit 504 applies one of the select test data voltages VTR, VTG, and VTB to the corresponding data lines DL1 to DLn to drive the respective data lines DL1 to DLn. During normal operations, the data driver (not shown) applies the data voltages VD1 to VDk to the data lines DL1 to DLn to drive the respective data lines DL1 to DLn.

As explained above, the number of output lines OL1 to OLk connecting the data driver (not shown) to the demultiplexers DEMUX1 to DEMUXk, respectively, is smaller than that of the data lines DL1 to DLn. The output lines OL1 to OLk are connected to output pins (not shown) of the data driver (not shown). The number (k) of the output pins is equal to that (k) of the output lines OL1 to OLk.

Figure 1:
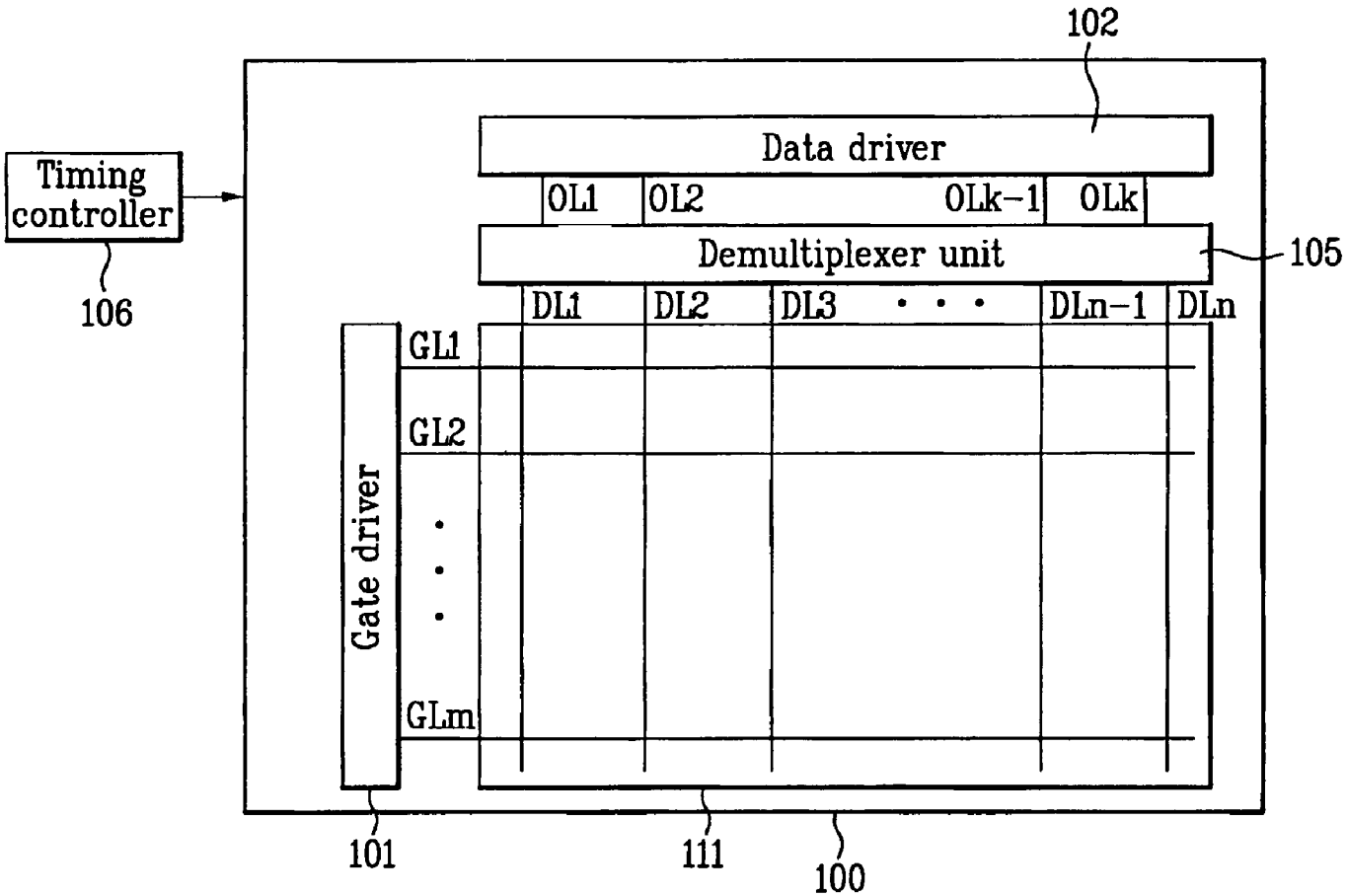
FIG. 1 Related Art
FIG. 1 is a block diagram of a liquid crystal display (LCD) device according to a related art.
Figure 2:
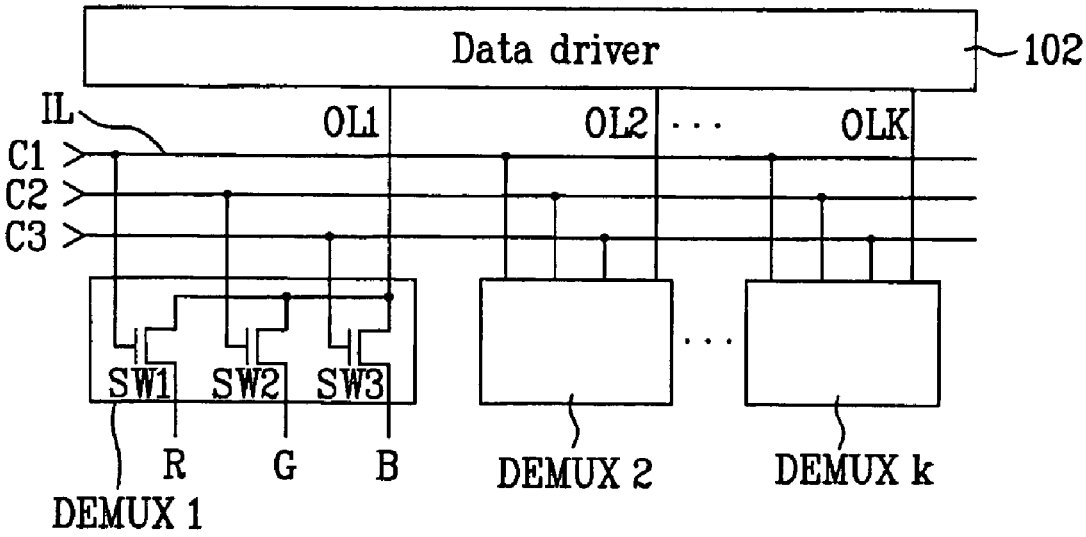
FIG. 2 Related Art
FIG. 2 is a detailed circuit diagram of a demultiplexer unit shown in FIG. 1.
Figure 3:
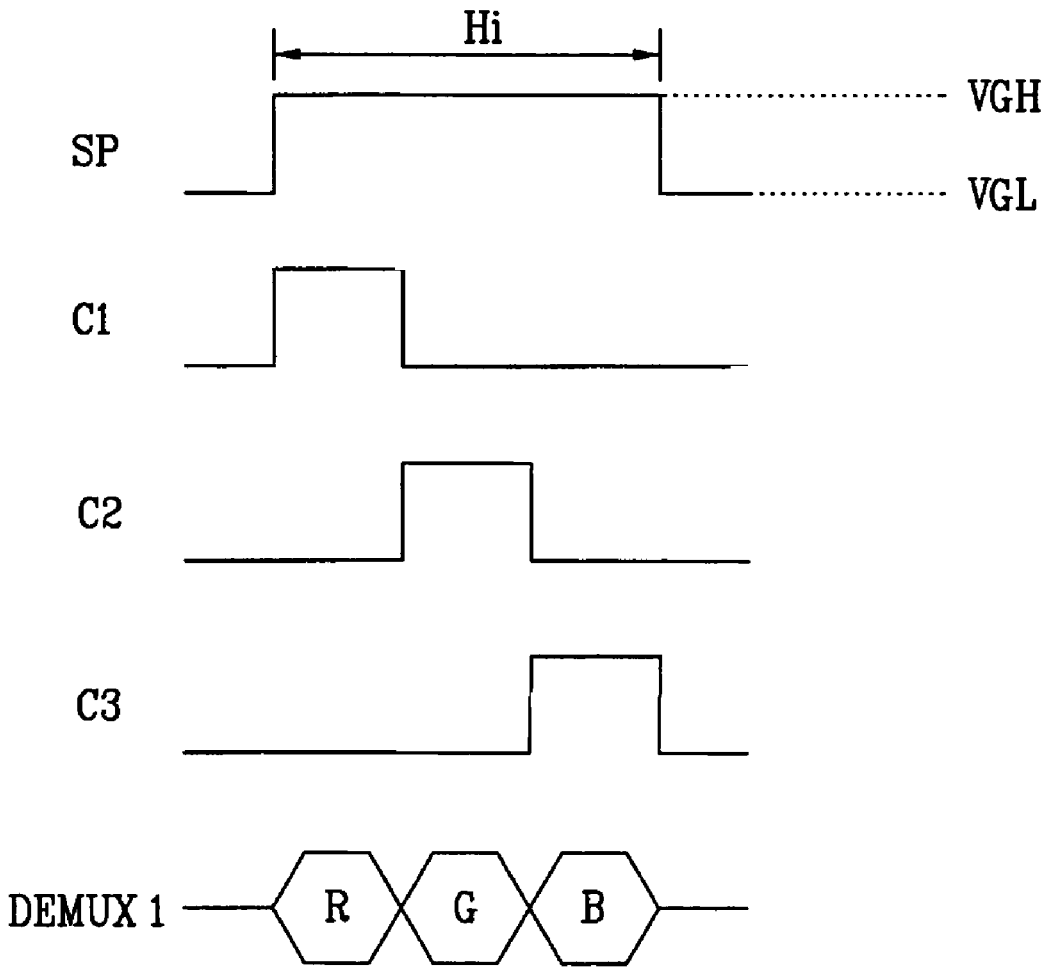
FIG. 3 Related Art
FIG. 3 is a diagram of drive waveforms of a first demultiplexer shown in FIG. 2 during a random horizontal sync interval.
Figure 4:
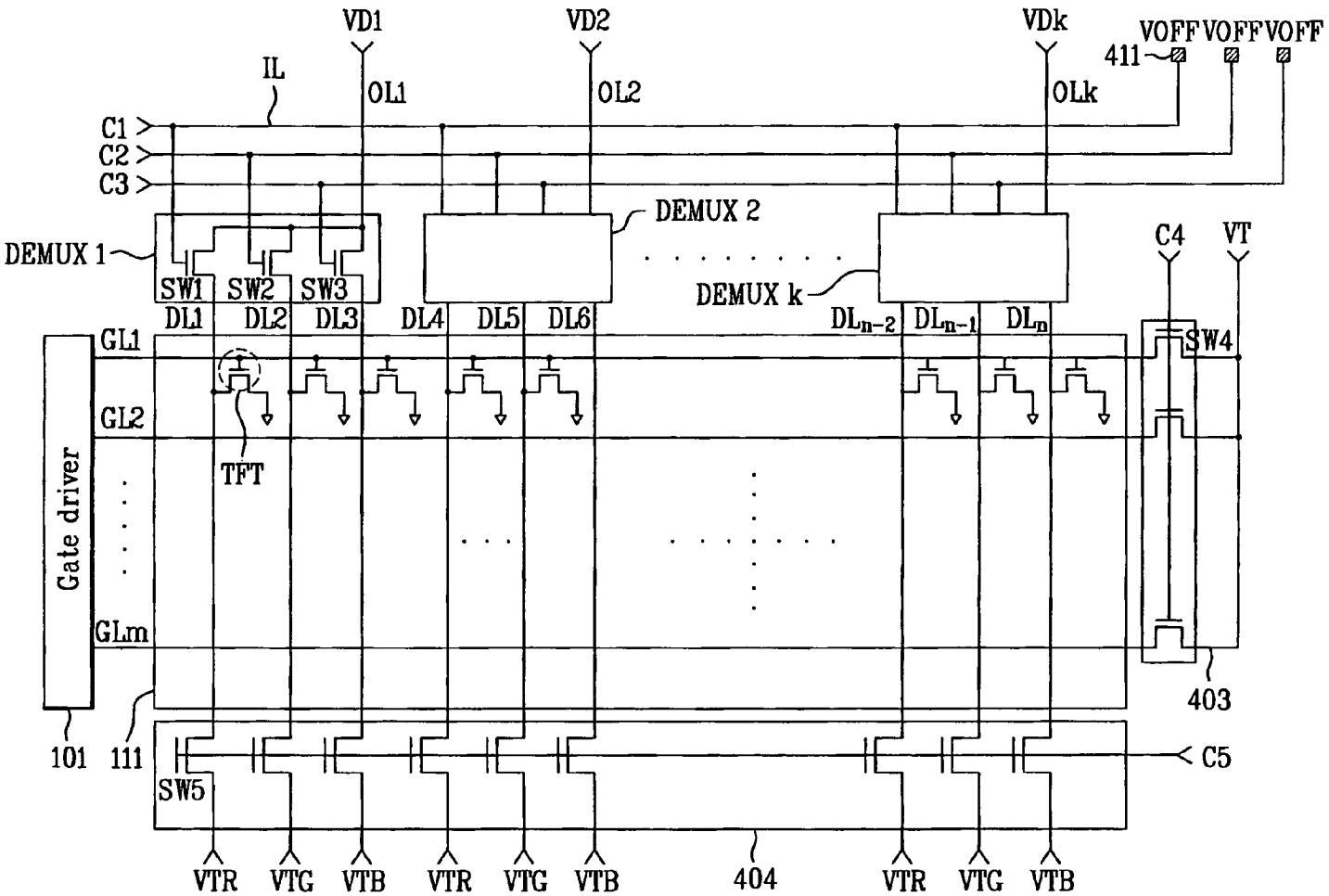
FIG. 4 Related Art
FIG. 4 is a block diagram of an LCD device having a gate line check unit and a data line check unit according to the related art.

Each of the demultiplexers DEMUX1 to DEMUXk includes first to third switching devices SW1 to SW3 connected in parallel to one output line OLk and to three of the data lines DL1 to DLn, respectively. The first to third switching devices SW1 to SW3 are turned on at different times in one horizontal period by first to third control signals C1 to C3 supplied from the timing controller (not shown), respectively. The gate driver 501 sequentially supplies a scan pulse voltage SP to m-gate lines GL1 to GLm for one frame. As shown in FIG. 3, a gate high voltage VGH, which is a high logic voltage of the scan pulse voltage SP, is maintained to drive a corresponding gate line during one horizontal sync period. In this case, the gate high voltage VGH is set to a voltage level that is greater than a threshold voltage of the TFT. Conversely, a gate low voltage VGL is a low logic voltage of the scan pulse voltage SP set as an off-voltage of the TFT.

During a horizontal sync period Hi of driving a selected gate line, the data driver (not shown) sequentially supplies k-data voltages VD1 to VDk to k-output lines OL1 to OLk connected to the k-demultiplexers DEMUX1 to DEMUXk, respectively. The k-data voltages VD1 to VDk supplied to the k-demultiplexers DEMUX1 to DEMUXk are synchronized with the first to third control signals C1 to C3 from the timing controller 106 to supply three data voltages from each of the k-data voltages VD1 to VDk to the three data lines connected to each of the demultiplexers DEMUX1 to DEMUXk to supply data signals to the n-data lines DL1 to DLn.

More specifically, in each of the k-demultiplexers DEMUX1 to DEMUXk, a gate electrode of the first switching device SW1 is connected to a signal input line IL of the first control signal C1. Likewise, a gate electrode of the second switching device SW2 is connected to a signal input line IL of the second control signal C2, and a gate electrode of the third switching device SW3 is connected to a signal input line IL of the third control signal C3. Hence, when the first to third control signals C1 to C3, as shown in FIG. 3, are sequentially shifted to a high state in one horizontal sync period Hi, the first to third switching devices SW1 to SW3 of each of the demultiplexers DEMUX1 to DEMUXk are driven in sequence from of the first switching device SW1 to the third switching device SW3. The data driver (not shown) sequentially outputs the corresponding data voltages VD1 to VDk to correspond to the drive sequence of the first to third switching devices SW1 to SW3. As a result, the first demultiplexer DEMUX1, as shown in FIG. 3, sequentially supplies the data voltage for R (red) to the first data line DL1 via the first switching device SW1, the data voltage for G (green) to the second data line DL2 via the second switching device SW2, and the data voltage for B (blue) to the third data line DL3 via the third switching device SW3.

The gate line check unit 503 includes m-fourth switching devices SW4 supplying the test scan pulse voltage VT to the m-gate lines GL1 to GLm in response to a fourth control signal C4. Namely, one of the fourth switching device SW4 is connected to one gate line. In particular, gate terminals of the fourth switching devices SW4 are connected in parallel to be supplied with the fourth control signal C4 in common. Drain terminals are individually connected to the gate lines GL1 to GLm, respectively, and source terminals are connected in parallel to be supplied with the test scan pulse voltage VT in common.

The data line check unit 504 includes n-fifth switching devices SW5 supplying the test data voltages VTR, VTG, and VTB to the data lines DL1 to DLn in response to a fifth control signal C5. In particular, gate terminals of the fifth switching devices SW5 are connected in parallel to be supplied with the fifth control signal C5 in common. Drain terminals are individually connected to the data lines DL1 to DLn, respectively, and source terminals are supplied with one of the test data voltages VTR, VTG, and VTB.

The switching unit 570, as shown in detail in FIG. 6, includes a plurality of sixth switching devices SW6. The number of the sixth switching devices SW6 is equal to that of the signal input lines IL. Each gate electrode of the sixth switching devices SW6 is supplied with a sixth control signal C6 in common. Each drain terminal is individually connected to the corresponding signal input line IL, and each source terminal is connected to the input terminal 511 in common. Hence, a cutoff signal VOFF is supplied to the three signal input lines IL using only one input terminal 511. As the fourth control signal C4, the test scan pulse voltage VT, the fifth control signal C5, the test data voltages VTR, VTG, and VTB, and the sixth control signal C6 are supplied from an external source, additional input terminals (not shown) for inputting these signals and voltages are provided on the LCD panel (not shown).

The gate and data line check units 503 and 504 are provided to check whether the gate and data lines GL1 to GLm and DL1 to DLn are in proper operating conditions. The switching unit 570 is provided to sustain the turned-off state of the first to third switching devices SW1 to SW3 of the demultiplexers DEMUX1 to DEMUXk during testing to prevent interference between the test data voltages VTR, VTG, and VTB applied to the data lines DL1 to DLn. When the gate and data line check units 503 and 504 and the switching unit 570 are activated, the gate driver 501 and the data driver (not shown) are deactivated. Moreover, since a timing controller (not shown) is not needed during the check process, the first to third control signals C1 to C3 are not supplied to signal input lines IL.

Specifically, the gate and data line check units 503 and 504 and the switching unit 570 temporarily operate the gate and data lines GL1 to GLm and DL1 to DLn during the test process. Hence, while the gate and data line check units 503 and 504 and the switching unit 570 are active, the gate driver 501 and the data driver (not shown) are not deactivated. Conversely, during normal operations, the gate and data line check units 503 and 504 and the switching unit 570 are deactivated while the gate driver 501, the data driver (not shown), and the timing controller (not shown) are active.

The display unit 555, the gate driver 501, the data driver (not shown), the gate line check unit 503, the data line check unit 504, and each of the demultiplexers DEMUX1 to DEMUXk are built into the LCD panel. In particular, the data driver (not shown) is mounted on the LCD panel in a form of chip (i.e., chip on glass "COG"). The timing controller (not shown) is provided external to the LCD panel.

To check the above-configured gate and data lines GL1 to GLm and DL1 to DLn and pixels of the liquid crystal display device according to the exemplary embodiment of the present invention, the sixth control signal C6 is supplied to the gate terminals of the sixth switching devices SW6 in the switching unit 570. In response, all of the sixth switching devices SW6 are switched on, thereby supplying the cutoff signal VOFF provided to the input terminal 511 from an external source to the signal input lines IL. Since the gate terminals of the first third switching devices SW1 to SW3 are connected to the signal input lines IL, the cutoff signal VOFF supplied to the signal input lines IL by the switching unit 570 maintains the off-state of the first to third switching devices SW1 to SW3.

While the first to third switching devices SW1 to SW3 are turned off, the fourth control signal C4 is applied to the gate line check unit 503. Accordingly, the fourth switching devices SW4 of the gate line check unit 503 are switched on, thereby supplying the test scan pulse voltage VT to the gate lines GL1 to GLm. Hence, all of the TFTs connected to the gate lines GL1 to GLm are activated.

Meanwhile, in response to the fifth control signal C5, the fifth switching devices SW5 of the data line check unit 504 supply the test data voltages VTR (test R data voltage), VTG (test G data voltage), and VTB (test B data voltage) to the corresponding data lines DL1 to DLn. In particular, the test R data voltage VTR is supplied to every third data line starting with the first data line DL1, i.e., the first data DL1, the fourth data line DL4, to the (n−2)th data line DLn−2. Similarly, the test G data voltage VTG is supplied to every third data line starting with the second data line DL2, i.e., the second data line DL2, the fifth data line DL5, to the (n−1)th data line DLn−1. Likewise, the test B data voltage VTB is supplied to every third data line starting with the third data line DL3, i.e., the third data line DL3, the sixth data line DL6, to the nth data line DLn. Accordingly, when the TFTs are switched on by the test scan test voltage VT, the test data voltages VTG, VTG, and VTB are supplied to the data lines DL1 to DLn.

By displaying the test image on the display unit 555 and by checking the abnormality of the image displayed on the display unit 555, the success/failure of the gate and data lines GL1 to GLm and DL1 to DLn, i.e., whether the gate and data lines GL1 to GLm and DL1 to DLn are connected or disconnected, can be confirmed. For instance, absence of images horizontally along a certain gate line indicates that the pixels connected to that gate line are not operating. Likewise, absence of images vertically along a certain data line indicates that the pixels connected to that data line are not operating. Moreover, if a specific pixel fails to display an image, such a condition indicates that the TFT connected to that particular pixel is malfunctioning.

Accordingly, the exemplary embodiment of the present invention as described above supplies the cutoff signal to all of the signal input lines using only one input terminal regardless of the increasing number of the signal input lines while still providing an effective way to check for proper operation of the pixels. Moreover, while the above-described example describes the checking process before the gate and data drivers are loaded, the LCD panel according to the present invention can be checked for proper operation at any time by deactivating the gate and data drivers and activating the testing units as described above.

It will be apparent to those skilled in the art that various modifications and variations can be made in the LCD device of the present invention without departing form the spirit or scope of the invention. Thus, it is intended that the present invention cover the modifications and variations of this invention provided they come within the scope of the appended claims and their equivalents.

What is claimed is:

1. A liquid crystal display device, comprising:

a display unit having matrix type pixels defined by gate and data lines crossing with each other;

a data driver to supply a data voltage to be supplied to the data lines via output lines, the output lines being less in number than the data lines;

a plurality of signal input lines supplying a plurality of control signals that are sequentially shifted to a high state in one horizontal sync period during normal operations and a cutoff signal during testing operations;

a plurality of demultiplexers supplying the data voltages of the output lines to one side of the data lines according to the plurality of control signals during the normal operations and cutting off the data lines from the output lines according to the cutoff signal during the testing operations;

a data line check unit activated to directly supply a plurality of test data voltages to the other side of the data lines when the data driver is inactive;

a single input terminal supplied with the cutoff signal to be inputted to the signal input lines to cut off the data lines from the output lines; and a switching unit commonly connecting the plurality of signal input lines to the single input terminal during the testing operations and commonly disconnecting the plurality of signal input lines from the single input terminal during the normal operations, according to an external control signal, wherein the single input terminal is further configured to send the cutoff signal to the switching unit along the same plurality of signal input lines while the plurality of control signals are at a low state, and wherein the plurality of demultiplexers are further configured to receive the cutoff signal to cut off the data voltage from the output lines.

2. The liquid crystal display device of claim 1, wherein the switching unit includes a plurality of switching devices, wherein gate terminals of the switching devices are commonly supplied with the external control signal, source terminals of the switching devices are commonly connected to the input terminal, and drain electrodes of the switching devices are individually connected to the signal input lines, respectively.

3. The liquid crystal display device of claim 1, further including a gate line check unit connected to one side of the gate lines to supply a test scan pulse voltage to temporarily drive the gate lines.

4. The liquid crystal display device of claim 3, further including a gate driver connected to the other side of the gate lines to sequentially supply a scan pulse voltage to drive the gate lines.

5. A liquid crystal display device, comprising:

a display unit having matrix type pixels defined by gate and data lines crossing each other;

a data driver to supply data voltages to output lines during normal operations;

a plurality of signal input lines supplying a plurality of control signals that are sequentially shifted to a high state in one horizontal sync period during the normal operations and a cutoff signal during testing operations;

a plurality of demultiplexers supplying the data voltages from data driver via the output lines to one side of the data lines according to the plurality of control signals during the normal operations and cutting off the data lines from the output lines according to the cutoff signal during the testing operations, each of the demultiplexers including a plurality of switching devices having a gate terminal, a source terminal, and a drain terminal, the gate terminals of each demultiplexer being individually connected to corresponding ones of the signal input lines, the source terminals of each demultiplexer being commonly connected to the output line corresponding to the demultiplexer, the drain terminals being individually connected to corresponding ones of the data lines;

single input terminal supplied with the cutoff signal to turn off the switching devices;

a switching unit commonly connecting the plurality of signal input lines to the single input terminal during the testing operations and commonly disconnecting the plurality of signal input lines from the single input terminal during the normal operations; and a data line check unit to directly supply a plurality of test data voltages to the other side of the data lines during the testing operations, wherein the single input terminal is further configured to send the cutoff signal to the switching unit along the same plurality of signal input lines while the plurality of control signals are at a low state, and wherein the plurality of demultiplexers are further configured to receive the cutoff signal to cut off the data voltage from the output lines.

6. The liquid crystal display device of claim 5, wherein the switching unit includes a plurality of switching devices, each of the switching devices having a gate terminal, a source terminal, and a drain terminal, wherein the gate terminals are supplied with a test control signal in common, the source terminals of the switching devices are connected to the input terminal in common, and the drain electrodes are individually connected to corresponding ones of the signal input lines.

7. The liquid crystal display device of claim 5, further including a gate line check unit to provide a test scan pulse voltage during the testing operations.

8. The liquid crystal display device of claim 5, further including a gate driver to sequentially supply a scan pulse voltage to drive the gate lines during the normal operations.

* * * * *